United States Patent [19]

Kiyonaga

[11] 4,278,462

[45] Jul. 14, 1981

[54] PROCESS FOR UPGRADING IRON ORE PELLETS

[75] Inventor: Kazuo Kiyonaga, Tarrytown, N.Y.

[73] Assignee: Union Carbide Corporation, New York, N.Y.

[21] Appl. No.: 712,259

[22] Filed: Aug. 6, 1976

[51] Int. Cl.[3] ..... C22B 1/214

[52] U.S. Cl. ..... 75/5; 75/3

[58] Field of Search ..... 75/3, 4, 5

[56] References Cited

U.S. PATENT DOCUMENTS

| | | | |
|---|---|---|---|
| 865,658 | 10/1907 | Scott | 75/5 |
| 926,289 | 6/1909 | Robinson | 75/5 |
| 1,166,903 | 1/1916 | Harding | 75/5 |
| 1,895,284 | 1/1933 | Hay | 75/5 |
| 2,532,335 | 12/1950 | Royster | 75/5 |
| 2,533,142 | 12/1950 | Royster | 75/5 |
| 2,595,574 | 5/1952 | Grossman | 75/5 |
| 2,624,560 | 1/1953 | Craig et al. | 75/5 |
| 2,744,743 | 5/1956 | Beggs et al. | 75/5 |
| 2,789,034 | 4/1957 | Swaine et al. | 75/5 |
| 3,158,463 | 11/1964 | Petkovich et al. | 75/3 |
| 3,259,483 | 7/1966 | Austin | 75/3 |
| 3,259,483 | 7/1966 | Cuscoleca et al. | 75/41 |
| 3,365,339 | 1/1968 | Beggs et al. | 75/3 |

FOREIGN PATENT DOCUMENTS

| | | | |
|---|---|---|---|
| 1186219 | 1/1965 | Fed. Rep. of Germany | 75/5 |
| 48-32799 | 9/1971 | Japan | 75/5 |
| 362053 | 2/1973 | U.S.S.R. | 75/5 |

*Primary Examiner*—Michael L. Lewis
*Attorney, Agent, or Firm*—Saul R. Bresch

[57] ABSTRACT

In a process for hardening oxidizable green iron ore pellets in a vertical shaft furnace, said process comprising passing the pellets through the furnace wherein said pellets are heated by contact with hot combustion gases and air, the furnace having a zone which is downstream of the introduction of the combustion gases, said zone having an average temperature in the range of about 1100° F. to about 2200° F., the improvement comprising directing a plurality of oxygen streams at the pellets passing through the periphery of said zone in such a manner that (a) each stream penetrates into the furnace about one to about six inches measured from the inside surface of the furnace wall along a line perpendicular to the theoretical vertical axis of the furnace;

(b) the velocity of each stream is sufficient to substantially prevent the stream from flowing up the furnace wall;

(c) the points of introduction of the streams are on the inside surface of the furnace wall located in the zone; and (d) any theoretical vertical line, which is parallel to the theoretical vertical axis of the furnace and along which line any point of introduction is located, is no more than about 12 inches from any other such theoretical line along which any other point of introduction is located.

7 Claims, 1 Drawing Figure

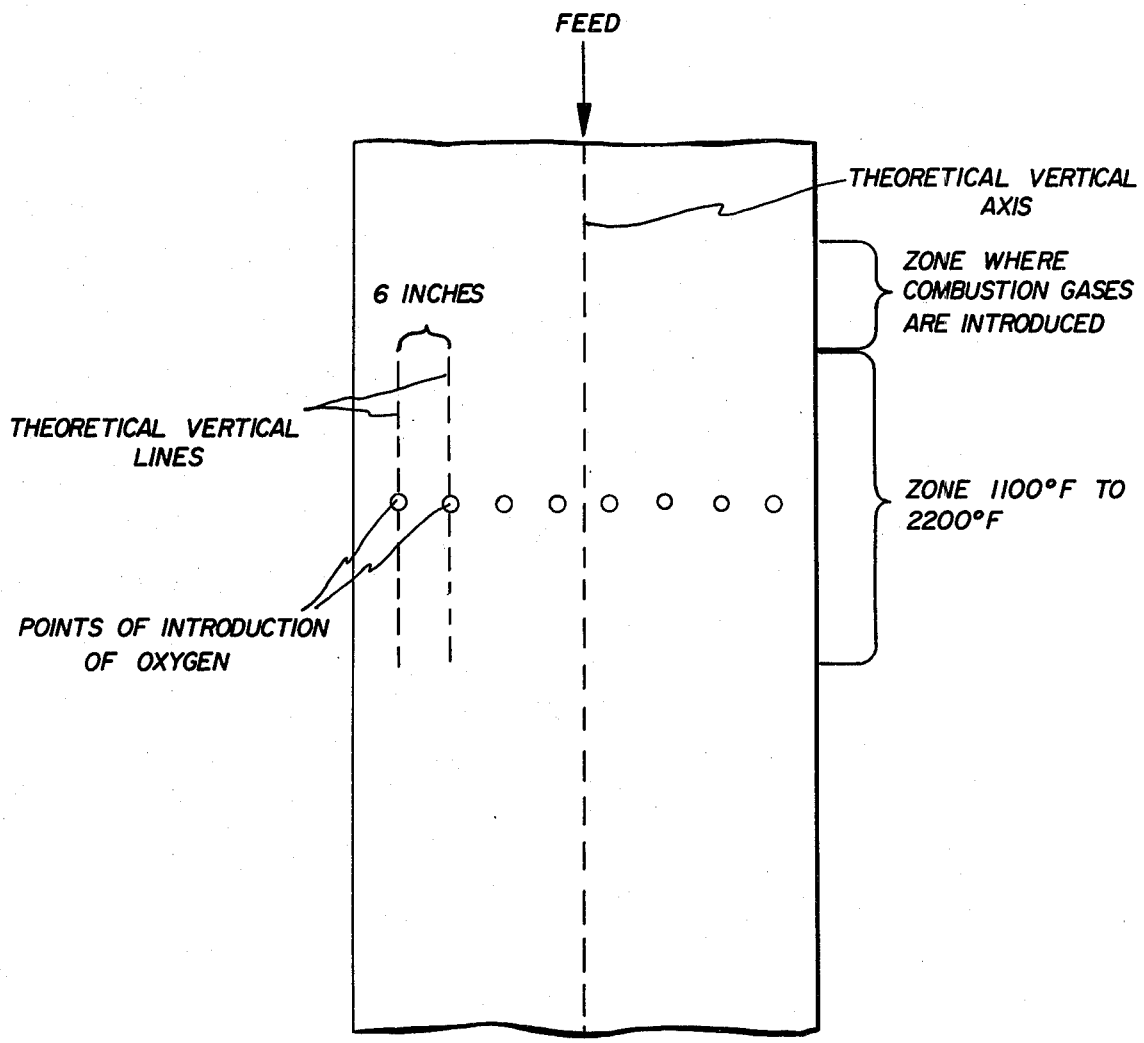
FEED
THEORETICAL VERTICAL AXIS
ZONE WHERE COMBUSTION GASES ARE INTRODUCED
6 INCHES
THEORETICAL VERTICAL LINES
ZONE 1100°F TO 2200°F
POINTS OF INTRODUCTION OF OXYGEN

PROCESS FOR UPGRADING IRON ORE PELLETS

FIELD OF THE INVENTION

This invention relates to a process for upgrading iron ore pellets in a vertical shaft furnace as the pellets undergo hardening.

DESCRIPTION OF THE PRIOR ART

The pelletizing of iron ore concentrates for use as charge material in blast furnaces has been gaining in importance in the steel industry. This is the result of an attempt to meet the increased demand for iron and steel with lower quality ores and ores extracted from beneficiation plants, all of which are usually in the form of finely divided particles, too finely divided for direct processing in a blast furnace.

The primary purpose of pelletizing in this industry is to improve burden permeability and gas-solid contact in the blast furnace in order to increase the rate of reduction. A secondary consideration is to reduce the amount of fines blown out of the blast furnace into the gas recovery system.

Characteristics of industrially acceptable pellets are those that are strong enough to withstand degradation during stockpiling, handling, and transportation and have the capability to withstand the high temperature and degradation forces within the blast furnace without slumping or decrepitating.

Typical pelletizing processes comprise forming $\frac{3}{8}$ inch to 1 inch diameter balls of iron ore concentrate of reasonable moisture content in a rotating drum or on a rotating disc and then firing the "green" balls or pellets in a furnace to a sufficiently high temperature to harden the pellets to a strength suitable for use in blast furnaces. The green pellets of interest here are those which contain an oxidizable material, usually magnetite ($Fe_3O_4$). Other oxidizable materials are iron and solid fuel such as coke, coal, or charcoal, which is sometimes added to the balling mix in a finely divided state in order to provide additional heat to the pellets during the hardening operation. The iron ore concentrate with which we are particularly concerned here contains at least about 30 percent magnetite; some iron or other iron compounds such as hematite; and a small amount of impurities such as silica, alumina and magnesia. One of these concentrates is known as beneficiated taconite. Binders are often added before or during the drum or disc rotation to increase the wet strength of the green pellets to acceptable levels for subsequent handling.

One of the basic types of furnaces used commercially for hardening green pellets is the vertical shaft furnace, which is typically about 60 feet in height and has an 8 foot by 20.5 foot rectangular cross-section. Such a furnace has an annual capacity of about 500,000 tons. Chambers for combustion of oil or gas are situated on each side of the shaft furnace. High temperature gases produced in these chambers are forced into the furnace around its periphery through ports located near the top of the combustion chambers. The green pellets are continuously deposited at the top of the vertical shaft by traveling conveyors which maintain a level stockline while hardened pellets are continuously withdrawn at the bottom. As the pellets descend the vertical shaft at the rate of about 1.3 inches per minute, they are dried, preheated, and then heated to about 2400° F. in the upper section (above the combustion chamber ports) by ascending air preheated in the lower section of the furnace by the descending hot pellets; by combustion chamber gases; and by heat released by the oxidation of magnetite to hematite (an exothermic reaction) and in some cases by oxidation of other fuels which have been added to the pellets. As the pellets move into the lower section, they are cooled by the countercurrent flow of air added at the bottom of the furnace. Chunk breakers break the lightly agglomerated pellets prior to further air cooling and subsequent discharge. The objective is to convert the green pellets into oxidized, strong, hard pellets which are abrasion resistant.

After the introduction of the combustion gases through the combustion chamber ports, i.e. downstream in terms of the movement of the pellets, there are areas in which oxidation, heat recovery, cooling, and discharge take place, and in these areas, there is a zone which has an average temperature in the range of about 1100° F. to about 2200° F., which is of interest here and which heretofore has not been delineated.

Strong bonding in the hardened pellets produced in the shaft furnace is believed to be due to grain growth from the accompanying oxidation of magnetite to hematite and to recrystallization of the hematite. The exothermic oxidation reaction typically supplies about 300,000 Btu's (British thermal units) per long ton of pellets.

Hardened pellet strength is usually determined by compression and tumbler tests. Although specifications for pellets vary depending on their source and the purchaser, the minimum suggested compressive strength for individual pellets ranges from about 300 pounds for $\frac{1}{4}$ inch pellets to about 800 to about 1500 pounds for 1 inch pellets. In the tumbler test, 25 pounds of plus $\frac{1}{4}$ inch pellets are tumbled for 200 revolutions at $24 \pm 1$ rpm (revolutions per minute) in a drum tumbler and then screened. Satisfactory commercial pellets generally contain less than about 6 percent of minus 28 mesh fines and more than 90 percent of plus $\frac{1}{4}$ inch pellets after the tumble test. In some cases, the tumble index has been modified to measure only the plus $\frac{1}{4}$ inch pellets present before and remaining after the tumble test and the price paid per long ton of pellets shipped is adjusted accordingly. Since production at a pelletizing plant is in the millions of tons per year range, a small improvement in tumble index (quality) of about 2 percentage points, for example, can represent significant additional income to the plant.

It is understood by those skilled in the art that one of the important factors in improving the quality of the pellets, both in terms of compressive strength and tumble index, is to provide for a more efficient conversion of magnetite to hematite in the furnace, the goal being, of course, one where all of the pellets produced are essentially hematite, or, at least, of higher hematite content.

Oxidation of magnetite to hematite during the pelletizing process is important not only because hematite is reduced more readily in the blast furnace in spite of its higher oxygen content, but also because in the pelletizing process, conversion of magnetite to hematite which is a strongly exothermic reaction, favors grain growth and sintering of the particles of iron ore concentrate to form hard, strong pellets that are abrasion resistant.

Since the reaction rate of magnetite in substantially pure oxygen is manyfold greater than that in air, it has been suggested that the combustion gases and air in the furnace be enriched with oxygen; however, the volume of gases circulating in a pelletizing plant is so large that any significant increase in oxygen concentration requires uneconomic amounts of oxygen, i.e. the cost of oxygen needed to provide higher numbers of pellets of essentially hematite or higher hematite content exceeds the additional income generated by the higher quality pellets. Further, it is recognized that a large percentage of the additional oxygen is wasted, in any case, because it flows over pellets, which would be converted to essentially hematite or at least a sufficient hematite content in a conventional operation.

SUMMARY OF THE INVENTION

An object of this invention, therefore, is to provide an improvement over conventional pelletizing processes whereby the hematite content of the hardened pellets is increased and the overall quality of pellets thereby improved.

Other objects and advantages will become apparent hereinafter.

According to the present invention, such an improvement has been discovered in a process for hardening oxidizable green iron ore pellets in a vertical shaft furnace, said process comprising passing the pellets through the furnace wherein said pellets are heated by contact with hot combustion gases and air, the furnace having a zone which is downstream of the introduction of the combustion gases, said zone having an average temperature in the range of about 1100° F. to about 2200° F.

The improvement comprises directing a plurality of oxygen streams at the pellets passing through the periphery of said zone in such a manner that (a) each stream penetrates into the furnace about one to about six inches measured from the inside surface of the furnace wall along a line perpendicular to the theoretical vertical axis of the furnace;

(b) the velocity of each stream is sufficient to prevent the stream from flowing up the furnace wall; and (c) the points of introduction of the streams are on the inside surface of the furnace wall located in the zone; and (d) any theoretical vertical line, which is parallel to the theoretical vertical axis of the furnace and along which line any point of introduction is located, is no more than about 12 inches from any other such theoretical line along which any other point of introduction is located.

DESCRIPTION OF THE PREFERRED EMBODIMENT

The preparation of the green pellets has been referred to above and is conventional. This invention is directed to that part of the pelletizing process whereby green pellets are hardened to the extent required for use in the blast furnace. As also noted, the apparatus, i.e. the shaft furnace, for carrying out the hardening aspect, the initial composition of the green pellets, the basic steps in the hardening process, and the combustion gases and air used in the process are conventional and are utilized here together with subject improvement.

The improvement here involves directing a plurality of oxygen streams at the pellets passing through the periphery of the particular temperature zone under a set of defined conditions. As noted, the zone is present in conventional shaft furnace operations, but until now has not been identified other than as part of a section of the furnace where oxidation, heat recovery, and cooling takes place.

The selected zone is that where the average temperature is in the range of about 1100° F. to about 2200° F. and preferably about 1300° F. to about 2000° F.

The oxygen stream can be a mixture of gases containing a major proportion or more than 50 percent by volume oxygen. It is preferably a mixture of gases containing at least about 90 or 95 percent by volume oxygen, however. The usual oxygen distributed commercially is considered to consist essentially of oxygen and it is expected that this oxygen would be the most easily obtained.

It is found that, by directing oxygen at the pellets in the periphery of the selected temperature zone under the defined conditions, maximum oxidation can be achieved with minimum oxygen consumption and the temperature of the pellets is raised thereby to provide more efficient thermal bonding which additionally raises the overall quality of the pellets.

The periphery of the zone is defined by the required penetration of the oxygen stream which is about one to about six inches as measured from the inside surface of the furnace wall on a line perpendicular to the theoretical vertical axis of the shaft furnace. Preferred penetration is about 2 to about 5 inches. It is noted that the stream penetrates beyond the space immediately adjacent to the wall substantially without loss of oxygen, but that the amount of oxygen declines along the path of the stream as it reacts.

The introduction of the oxygen streams can be accomplished by having a series of injection ports at the same level or several levels around the circumference of the furnace with minimum spacing, one to three inches, for example, between the ports. In this case, each oxygen stream is perpendicular to the wall or axis. A more preferred mode is to space injections at larger intervals, six inches, for example, and have two injector ports for each injector with the streams directed 90 to 160 degrees apart or approximately 10 to 45 degrees from the wall. In this case, a larger area is covered by the multiport injector. The flows of oxygen can be kept constant in these arrangements. Another mode of operation may be referred to as the "pulse-flow" mode, a form of alternate flow, where the injectors are connected to 2 or more manifolds along the circumference of the furnace, and the entire flow of oxygen is sent through one manifold at a time, in timed intervals, a complete rotation being made, for example, in two minutes or less. Thus flow rates of oxygen through the injectors are increased accordingly; penetration and coverage are increased; and pellet oxidation is faster. Various patterns of injection ports within the zone can be used provided that the condition of distance mentioned above is observed, i.e., any theoretical line, which is parallel to the theoretical vertical axis of the furnace and and along which line any point of introduction is located, is no more than about 12 inches, and preferably no less than about 0.5 inch, from any other such theoretical line along which any other point of introduction is located.

Various patterns of flow, in addition to those described, can also be used. The total flow rate is determined initially on the basis of the analysis of samples of the pellets in the periphery of the zone prior to using the defined conditions. The flow rate of each injector can then be selected based on the desired rate and flow pattern whether continuous, alternating or intermittent.

It is preferred that the vertical spacing of the injection ports is such that there is no more than about 36 inches between the port (or point of introduction of the oxygen stream) closest to the top of the furnace and the port farthest away from the top of the furnace. The measurement is made along a theoretical vertical line running parallel to the theoretical vertical axis of the furnace from the point on the top of the furnace residing on the vertical line to the port in question residing along that same theoretical line. Measurements for the closest port and the farthest port are made and the difference between the two is preferably no more than about 36 inches.

The amount of oxygen supplied to the periphery of the zone is usually sufficient to convert essentially all of the magnetite in the periphery of the zone to hematite as determined on a theoretical basis. The same analysis as mentioned above for the determination of flow rate can, of course, be used to determine this amount. It is preferred that about 0.3 mole to about 2 moles of oxygen be used for each mole of magnetite passing through the periphery of the defined zone. The higher the quality of the pellet product desired, the higher the amount of oxygen which may be used, however. In any case, the quality will be upgraded.

It is found that the velocity of the stream should be sufficient to substantially overcome the tendency of the oxygen to flow up the furnace wall due to the high permeability prevailing there in the shaft system. This velocity can range from about 10 feet per second to about 1000 feet per second and is preferably greater than about 50 feet per second. This is accomplished conventionally by adjusting the pressure at which the oxygen stream is supplied and/or by use of a suitably sized nozzle.

The sole FIGURE of the drawing is a schematic diagram of a partial side view cross section of a vertical shaft furnace. The points of introduction of oxygen are, as noted above, on the inside of the furnace wall.

I claim:

1. In a process for hardening oxidizable green iron ore pellets in a vertical shaft furnace adapted therefor, said process comprising passing the pellets through the furnace wherein said pellets are heated by contact with hot combustion gases and air, the furnace having a zone which is downstream of the introduction of the combustion gases, said zone having an average temperature in the range of about 1100° F. to about 2200° F., the improvement comprising directing a plurality of gas streams consisting essentially of oxygen at the pellets passing through the periphery of said zone in such a manner that (a) each stream penetrates into the furnace about one to about six inches measured from the inside surface of the furnace wall along a line perpendicular to the theoretical vertical axis of the furnace;

(b) the velocity of each stream is sufficient to substantially prevent the stream from flowing up the furnace wall;

(c) the points of introduction of the streams are on the inside surface of the furnace wall located in the zone; and (d) any theoretical vertical line, which is parallel to the vertical axis of the furnace and along which line any point of introduction is located, is no more than about 12 inches from any other such theoretical line along which any other point of introduction is located.

2. The process defined in claim 1 wherein the velocity of the stream is about 10 to about 1000 feet per second.

3. The process defined in claim 2 wherein the amount of oxygen used is in excess of that theoretically required to convert any magnetite in the periphery of the zone to hematite.

4. The process defined in claim 3 wherein the stream penetration is about 2 to about 5 inches.

5. The process defined in claim 2 wherein the zone has an average temperature in the range of about 1300° F. to about 2000° F.

6. The process defined in claim 5 wherein the distance between lines in condition (d) is no less than about 0.5 inch.

7. The process defined in claim 6 wherein the velocity of the stream is at least about 50 feet per second.

* * * * *